United States Patent [19]

Saviolo

[11] Patent Number: 4,593,643

[45] Date of Patent: Jun. 10, 1986

[54] DEVICE FOR THE APPLICATION OF IDENTIFICATION MARKS TO TUBES FOR THE WINDING OF TEXTILES

[75] Inventor: Giuseppe Saviolo, Palestro, Italy

[73] Assignee: Sant'Andrea Novara Officine Meccaniche e Fonderie S.p.A., Novara, Italy

[21] Appl. No.: 606,101

[22] Filed: May 2, 1984

[30] Foreign Application Priority Data

May 2, 1983 [IT] Italy ..... 67469 A/83

[51] Int. Cl.[4] ..... B05C 1/02

[52] U.S. Cl. ..... 118/72; 118/211; 118/221; 118/226; 118/239; 118/DIG. 11; 118/264

[58] Field of Search ..... 118/72, 264, 211, 234, 118/235, 226, DIG. 11, DIG. 13, 218, 219, 221, 239; 242/1

[56] References Cited

U.S. PATENT DOCUMENTS

| | | | |
|---|---|---|---|
| 935,229 | 9/1909 | Phelps | 118/219 X |
| 1,931,252 | 10/1933 | Cooke et al. | 118/226 |
| 1,946,428 | 2/1934 | Preston et al. | 118/264 X |
| 3,044,907 | 7/1962 | Bernhardt | 118/DIG. 11 |
| 3,554,163 | 1/1971 | Scott | 118/234 X |
| 4,332,213 | 6/1982 | Marino | 118/211 |

*Primary Examiner*—John P. McIntosh

*Attorney, Agent, or Firm*—Sughrue, Mion, Zinn, Macpeak and Seas

[57] ABSTRACT

Apparatus for the application of marks to tubes used for the winding of textiles for the identification of the composition, quality and/or origin of the textiles. Device includes a flighted elevator conveyor adapted to take tubes from the bottom of a container and to transfer them to an inking assembly with marking tips which mark the ends of the tubes. Rotary brushes clean the tube ends prior to marking.

3 Claims, 4 Drawing Figures

Figure 1:
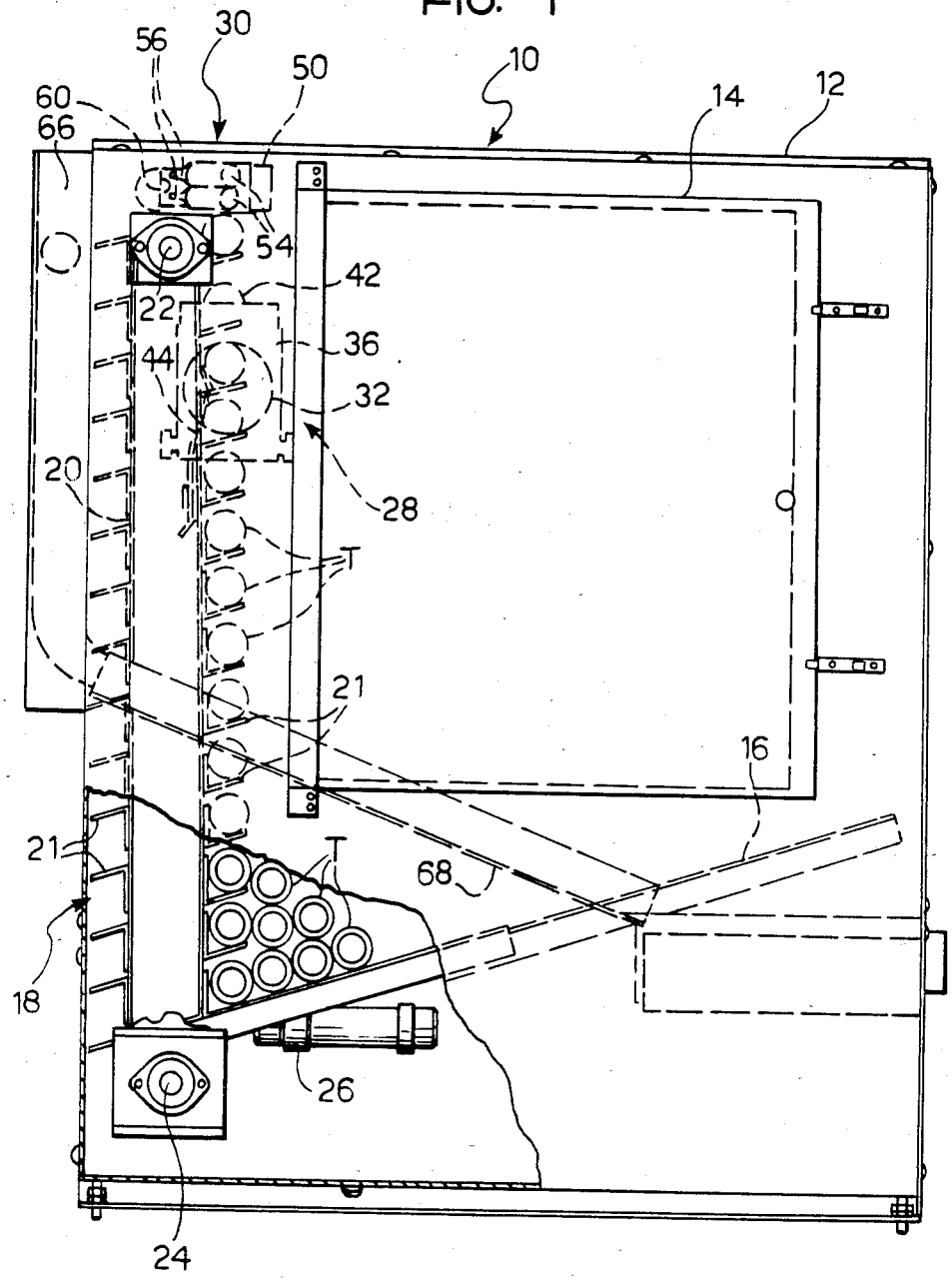

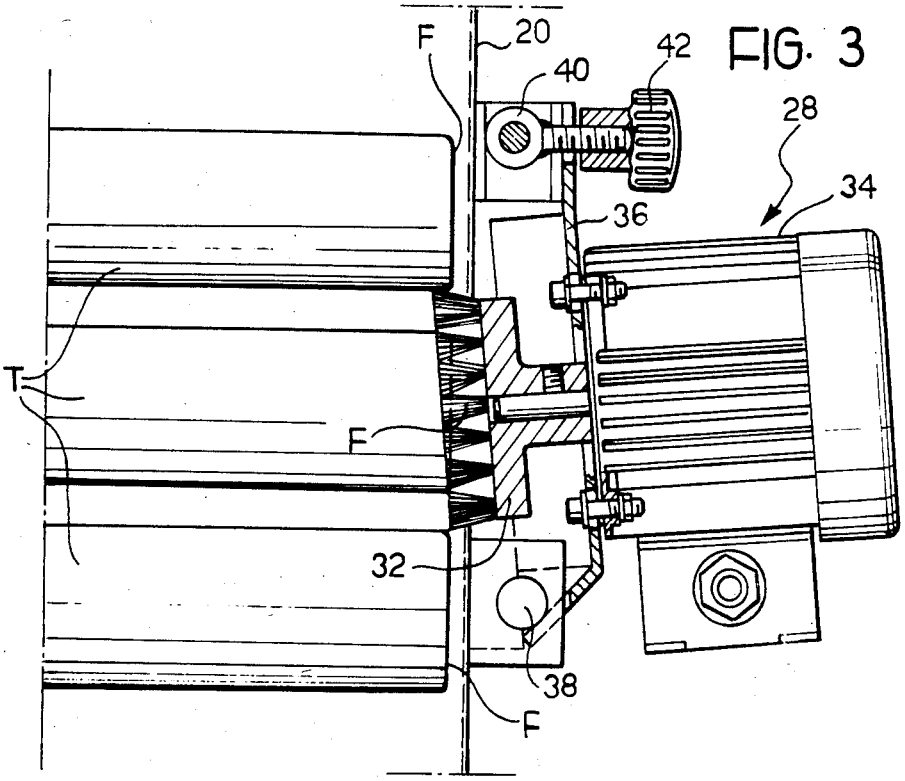
FIG. 3
FIG. 4
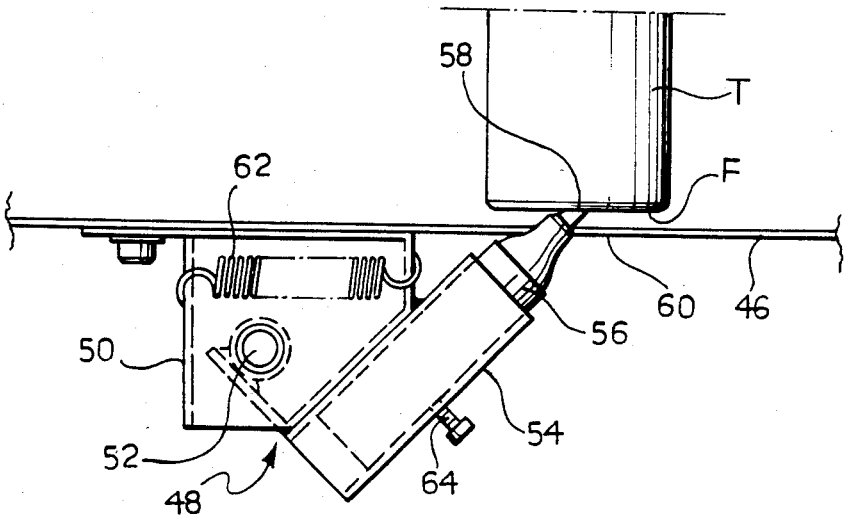

DEVICE FOR THE APPLICATION OF IDENTIFICATION MARKS TO TUBES FOR THE WINDING OF TEXTILES

The present invention relates to the application of identification marks to tubes intended to form spool cores for winding textiles, for example on the winding frame of a spinning machine or the like. Such marks have the function of allowing identification of the quality or composition or the origin or even the working process which distinguish the textiles which are to be rolled on the tubes.

According to the prior art, the identification marks are generally constituted by labels of paper or coloured card on which the identification data are given and which are attached manually or mechanically to the outer surfaces of the core tubes. The manual application of the labels obviously requires operations which are difficult and often dangerous for the operator particularly when they are to be carried out while the textile machine is operating, given the high working speed of the devices for forming the spools. On the other hand the stoppage of the textile machine for the application of the labels would result in a considerable reduction in the efficiency of the machine and is obviously unacceptable.

For the mechanised application of the labels, automatic application systems are known, one of which, for example, is the subject of Italian Patent No. 1,047,341 in the name of the same applicants which, although eliminating the intervention of the operator for the application of the label to the spool, is relatively complicated and expensive and in any case involves the need to load the labels into the applicator devices manually.

In each case it has been found that the application of an extraneous body to the wound spool between the core tube and the wound textile may cause disadvantages in the subsequent treatment stage of the textile.

The object of the present invention is to avoid these disadvantages by eliminating the labels through a marking system which allows identification marks to be applied relatively simply and economically to the core tubes simultaneously with the normal operation of the machine using such tubes.

In order to achieve this object the present invention provides a method for the application of identification marks to core tubes for the winding of textiles, characterised in that it consists in the application of erasible ink marks to at least one of the ends of each tube.

Normally the application of the erasible ink marks is carried out by wiping with ink marker tips.

The erasible ink is preferably of the type which can be erased by brushing and the ends of the tubes are cleaned by brushing before the application of the erasible ink marks.

The invention also provides a device for carrying out the method defined above, the main characteristic of which lies in the fact that it includes inking means for applying erasible ink marks to at least one of the ends of each tube.

According to the invention the device includes a container for containing the tubes which has an inclined base wall, a conveyor device in the form of an elevator with flights for taking up the tubes individually from the container and transferring them successively to the inking means, making them pass through brushing means, and take-up means for the tubes at the outlet of the inking means.

Figure 2:
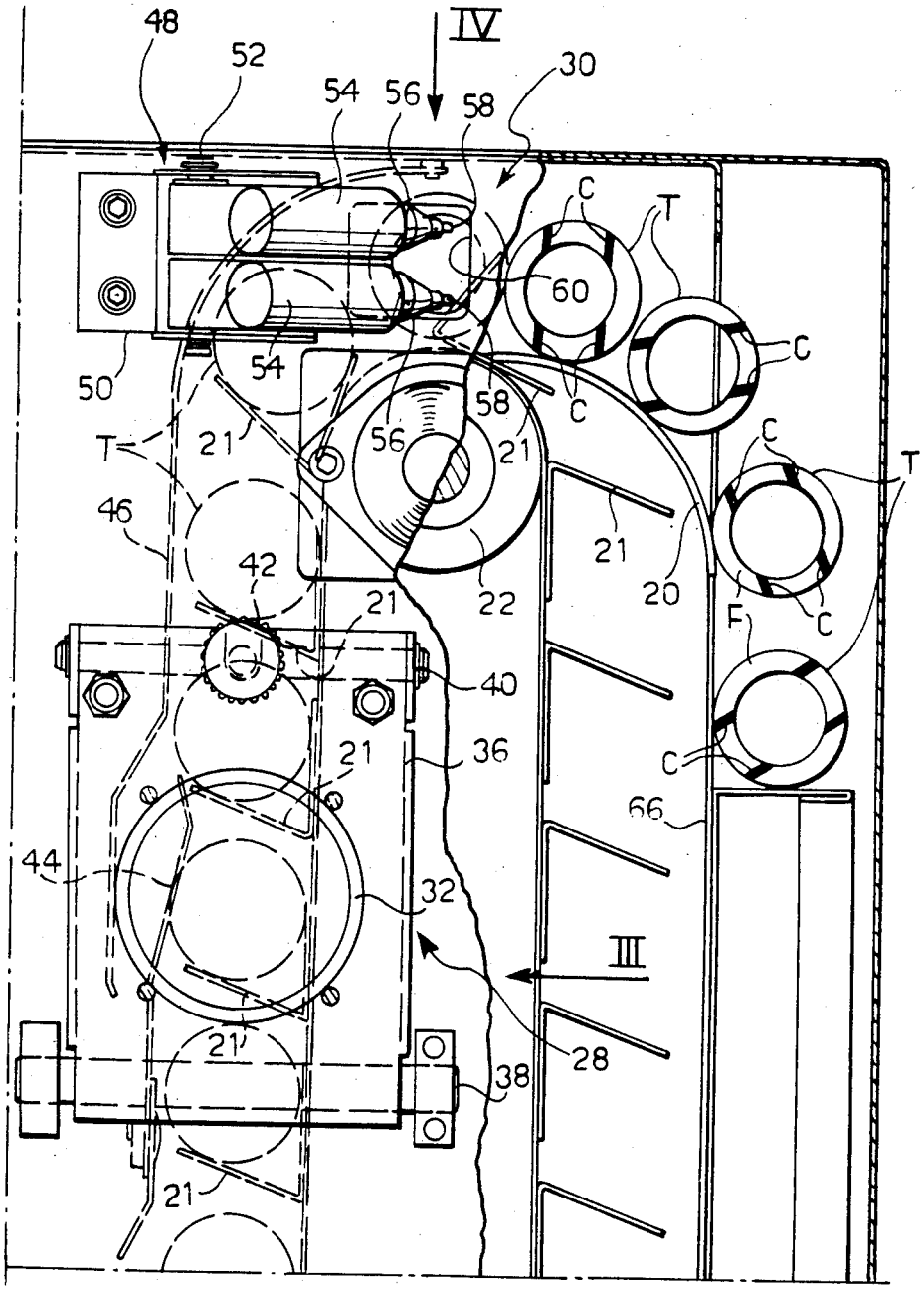

The invention will now be described in detail with reference to the appended drawings, provided purely by way of non-limiting example, in which:

FIG. 1 is a partially sectioned schematic plan view of a device according to the invention for applying identification marks to core tubes for the winding of textiles, FIG. 2 illustrates a detail of the devices on an enlarged scale, FIG. 3 is a partially sectioned schematic view taken on the arrow III of FIG. 2, and FIG. 4 is a partial plan view from above taken on the arrow IV of FIG. 2.

In the drawings a device according to the invention for the application of identification marks to core tubes T for the winding of textiles is generally indicated 10. The device 10 is intended to be associated with a textile machine, for example the winding frame of a spinning machine.

The device 10 is constituted by a parallelepiped shaped container 12 having a front hatch 14 which can be opened to allow the loading of the tubes T, and having an inclined base forming a slide 16 sloping downwardly towards the base of a flighted elevator 18 which extends vertically up one side of the container 12.

The flighted elevator 18 is formed by a pair of endless belts 20 which carry a plurality of conveyor flights 21 and which are wound around two pulleys carried by an upper shaft 22 and a lower shaft 24 respectively. The lower pulley is driven by a pneumatic actuator 26 and a cam device, not illustrated to effect the intermittent advance of the elevator 18 through predetermined steps. The drive is such that the pass of the belt 20 facing the inclined slide moves upwardly, that is towards a cleaning assembly 28 and a marking assembly 30.

As illustrated in detail in FIG. 3, the cleaning assembly 28 includes a pair of rotary brushes, only one of which is indicated at 32, disposed on opposite sides on the path of movement of the conveyor pass of the elevator 20 and spaced apart by a smaller distance than the axial length of the tubes (T). The two rotary brushes 32, each of which is driven by an independent electric motor 34, thus act on the opposite end faces F of the tubes T during the passage thereof through the cleaning assembly 28.

The motors 34 for driving the brushes 32 are fixed to respective supports 36 each of which is articulated at its lower end to a pin 38 carried by the walls of the container 12 and is connected at its upper end to an attachment 40 so as to be disengageable by means of a manually operable knob 42. This allows the supports 36 to be inverted periodically about the pins 38 to facilitate maintenance, cleaning and eventual replacement of the brushes 32.

As is best seen in FIG. 2, the cleaning assembly 28 has an associated sprung wall 44 in the form of a leaf spring which bears against the side surfaces of the successive tubes T reaching the cleaning assembly 28 in turn, so as to prevent their rotating against the respective blades 21 during the cleaning operation by the rotary brushes 32, in the manner which will be clarified below.

Above the cleaning assembly 28 is a curved connector guide 46 which follows the path of the conveyor pass of the elevator 18 up to the marking assembly 30, which is located at the apex of the elevator immediately above the shaft 22 carrying the upper drive pulley.

As illustrated in greater detail in FIGS. 2 and 4, the marking assembly 30 is constituted by a pair of inking units 48 located on opposite sides of the path of advance of the tubes T to apply to the opposite faces F thereof erasible ink traces acting as identification marks.

Each inking unit 48 includes a support 50 fixed to the exterior of the connector guide 46 and carrying a pin 52 to which is articulated a sheath container 54 in which inkers 56 are inserted (in the embodiment illustrated there are two) containing a coloured ink which can be erased by means of brushing. The inkers 56 have respective ink marker tips 58 which pass through apertures 60 in the connector guide 46 and are urged resiliently by helical tension springs 62 towards the zone of passage of the end faces F of the tubes T. The inkers 56 are inserted in respective sheaths 54 so as to be removable in order to allow their rapid replacement and are locked by retaining screws 64.

Reference 66 indicates a withdrawal chute located close to the first portion of the descending pass of the elevator 20 and arranged to receive the tubes T leaving the marking assembly 30 and to direct them to an external chute 68 which feeds the tubes T to the textile machine.

The operation of the device according to the invention is as follows.

The tubes T coming from preceding spinning operations and possibly already marked by erasible ink marks are introduced into the container 12 through the hatch 14 and are taken individually by the flights 21 of the conveyor pass of the elevator 18 in the manner illustrated in FIG. 1. By the intermittent advance of the elevator 18 the tubes T are successively passed through the cleaning assembly 28 at which the rotary brushes 32 rub out any existing ink marks from the faces F of the tubes T. During this phase the leaf spring wall 44 prevents the tubes T from rotating and avoids undesirable vibrations, thus ensuring better and more complete removal of the previous ink marks by the rotary brushes 32.

The cleaned tubes T then enter the connector part 46 and reach the marking assembly 30 where the marker tips 58 of the inkers 56 apply erasible ink marks C to the opposite faces F of the tubes T. The application is clearly effected by wiping of the marker tips 58 against the faces F under the action of the tension springs 62.

At the outlet from the marker assembly 30, the tubes T reach the withdrawal chute 66 and are directed to the external chute 68 from which they will be taken automatically to be conveyed to the zones for take-up by the textile machine upon replacement of the formed spools.

Obviously the colours of the inks in the inkers 56 will be chosen in dependence on predetermined identification codes by means of which one can determine the composition and/or quality and/or origin and/or working process corresponding to the textiles wound on the tubes T.

Finally it should be noted that the erasible ink marks C could be applied to the outer cylindrical surface of the tubes T close to one or both of the said end faces F instead of to the end faces F themselves of the tubes T.

Naturally, the constructional details and embodiments of the device may be varied widely with respect to those described and illustrated and without thereby departing from the scope of the present invention.

What is claimed is:

1. A device for the application of identification marks to tubes for the winding of textiles, comprising tube supplying means, a conveyor device for conveying individual tubes parallel to each other from said tube supply means along a predetermined path, tube marking means comprising two inking units located on opposite sides of said path for applying ink marks on opposite ends of said tubes, each of said two inking units comprising at least one wiping type ink marker resiliently biased toward said path for engagement with one end of each tube passing said marker for applying an erasable ink mark to one end of each tube.

2. Device according to claim 1, further comprising brushing means between said tube supply means and said marking means, said brushing means comprising two brushing units located on opposite sides of said path for engaging opposite ends of said tubes.

3. Device according to claim 2, in which each of said two brushing units comprises a rotary brush, projecting towards said path for cleaning an end of each tube before application of the erasable ink marks.

* * * * *